US007785028B2

(12) United States Patent
Cont et al.

(10) Patent No.: US 7,785,028 B2
(45) Date of Patent: Aug. 31, 2010

(54) COVERING ELEMENT FOR MANUAL-USE ARTICLES PARTICULARLY SET FOR LAYING OF AT LEAST ONE SUBSTANCE, AND MANUAL-USE ARTICLE PROVIDED WITH SUCH A COVERING ELEMENT

(75) Inventors: Franco Cont, Lugano (CH); Giancarlo Bozzani, Milan (IT)

(73) Assignee: F.I.L.A. - Fabbrica Italiana Lapis ed Affini S.p.A., Milan (IT)

( * ) Notice: Subject to any disclaimer, the term of this patent is extended or adjusted under 35 U.S.C. 154(b) by 1062 days.

(21) Appl. No.: 11/498,807

(22) Filed: Aug. 4, 2006

(65) Prior Publication Data

US 2007/0147951 A1 Jun. 28, 2007

(30) Foreign Application Priority Data

Dec. 22, 2005 (EP) ..... 05425905

(51) Int. Cl.
*B43K 23/12* (2006.01)

(52) U.S. Cl. ..... 401/243; 401/202; 401/213

(58) Field of Classification Search ..... 401/6, 401/98, 202, 213, 243, 246, 247, 269; 215/295, 215/305; D19/57
See application file for complete search history.

(56) References Cited

U.S. PATENT DOCUMENTS 1,201,082 A * 10/1916 Nussbaumer ..... 215/305
5,352,053 A * 10/1994 Reitze ..... 401/202
6,036,385 A * 3/2000 Bistrack ..... 401/6
D425,124 S * 5/2000 Chen ..... D19/57
6,168,024 B1 1/2001 Coates et al.
6,695,513 B1 * 2/2004 Malek ..... 401/129
D504,464 S * 4/2005 Martzloff ..... D19/43

FOREIGN PATENT DOCUMENTS

| | | |
|---|---|---|
| DE | 91 15 124 | 4/1992 |
| EP | 0 703 096 | 3/1996 |
| WO | WO 98/19871 | 5/1998 |

* cited by examiner

*Primary Examiner*—David J Walczak
(74) *Attorney, Agent, or Firm*—Young & Thompson

(57) ABSTRACT

A covering element (1) for manual-use articles such as pens, felt-tip pens, correction fluids and the like, comprises a case (3) adapted to receive a respective article (2) by insertion. The covering element (1) further comprises coupling means to ensure engagement of the covering element (1) with the respective article (2). Advantageously, the covering element is also provided with abutment means (5) associated with the case (3) to cause shifting of the covering element (1) between a coupled condition and a released condition, by effect of at least one manual action. The abutment means (5) consists of respective abutment surfaces (7, 9) protruding from the case (3) to enable a manual thrust to be exerted on the covering element (1).

12 Claims, 2 Drawing Sheets

FIG 3
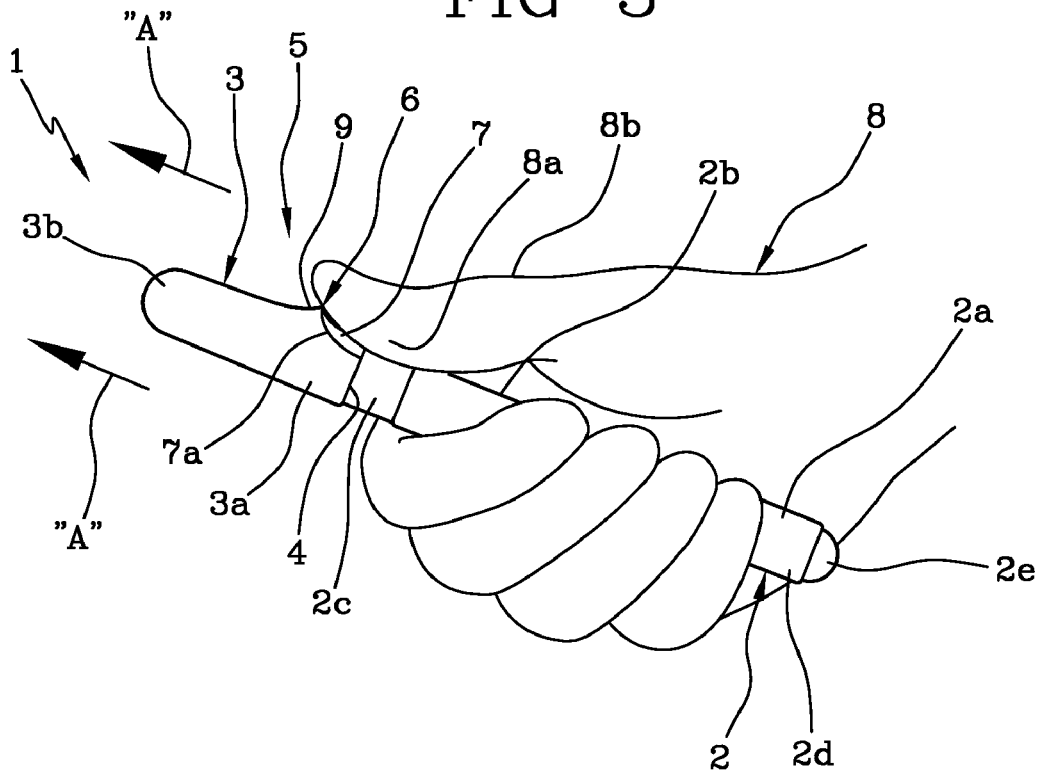
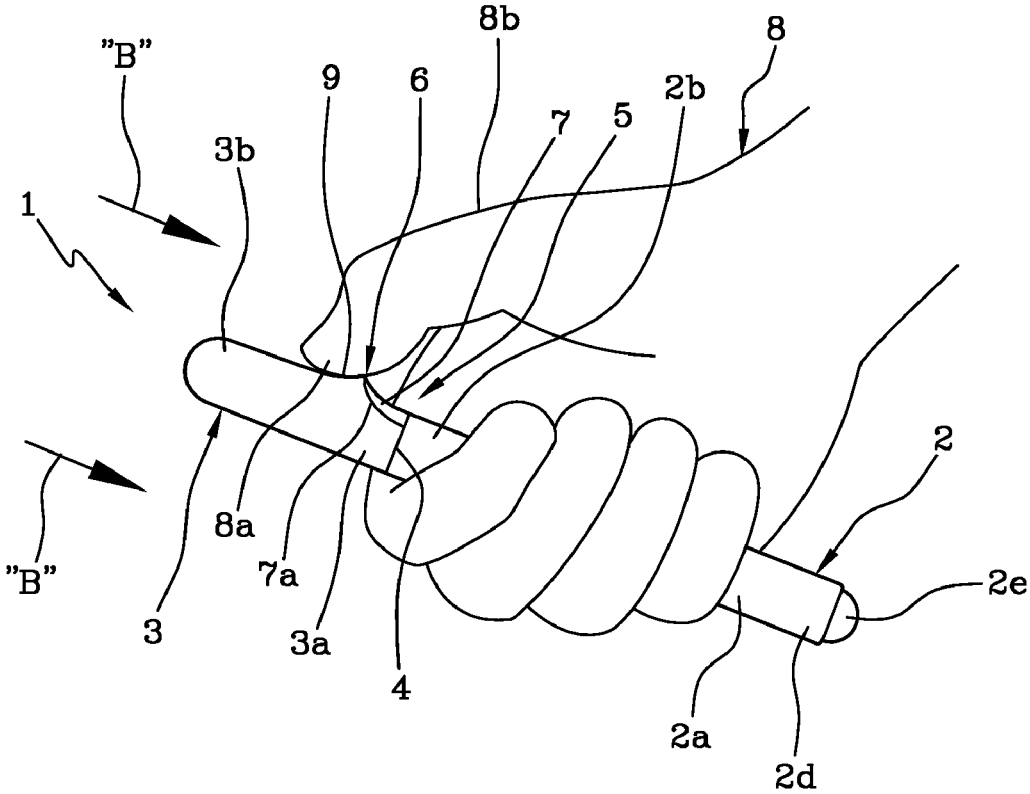
FIG 4

COVERING ELEMENT FOR MANUAL-USE ARTICLES PARTICULARLY SET FOR LAYING OF AT LEAST ONE SUBSTANCE, AND MANUAL-USE ARTICLE PROVIDED WITH SUCH A COVERING ELEMENT

FIELD AND BACKGROUND OF THE INVENTION

The present invention relates to a covering element for manual-use articles, particularly set for laying of at least one fluid substance.

The present invention is also concerned with a manual-use article, such as a pen or similar device for laying a fluid substance, which is provided with the above mentioned covering element.

The invention is adapted for use in any merchandise field and on any manual-use article requiring outer covering for a particularly sensitive and/or delicate portion thereof. With reference to stationery articles for example, the object of the present invention can apply to pens, felt-tip and marking pens, correction fluids, glues and/or similar goods, to protect the tip of same when they are not in use. The present invention can also be widely used in the field of beauty preparations such as lipsticks, mascara, eyeliners and similar products in tubes or sticks. Obviously, the application of the present invention is of such a wide range that it cannot be limited to any specific merchandise field as it spreads over many different sectors.

It is known that covering of particularly sensitive and/or delicate portions of articles such as those mentioned above, usually relies on lids, caps, plugs and/or similar covering elements that are generally applied through screwing and/or mutual engagement by fitting. In particular, when the covering element is put back onto the respective article, at the use portion thereof, the closing element is screwed down or pushed towards the body or the corresponding article through a manual action, until the desired engagement is obtained.

In the same manner as application of the closing element onto the corresponding article takes place, release of the use portion is carried out by unscrewing the covering element or moving it apart until the same is separated from the engaged article. Application and release of the covering element are both executed manually by use of two or more fingers so that full use of the corresponding hand is required.

Where the article is provided with screw-engagement means, for said application and release operations also use of the other hand is required as it must help the first one in imparting a rotation to the article around its longitudinal axis in the opposite direction to the action of the hand active on the covering element. On the contrary, in the presence of means carrying out engagement by fitting, the body of the article is to be pulled in the opposite direction relative to the hand carrying out separation of same.

By virtue of the above, the Applicant has found that while the known covering elements for articles of manual use satisfactorily protect the sensitive and/or delicate portions of the goods to which they are usually applied, they however have some drawbacks and can be improved under different points of view.

In particular, the Applicant has sensed that said covering elements can be improved in relation to disengagement or release of same from the respective articles, and comfort and ease in carrying out this operation.

In fact the Applicant has found that the present articles for manual use compulsorily need use of both hands to cause disengagement of the covering element and/or application of same. While meeting this requirement is usually very simple, it may become particularly difficult when at least one hand of the user is, for any reason, unable to carry out said operations. In other words, the impossibility of use of one hand makes it hard to execute an operation that is apparently easy.

The Applicant has finally sensed that the present techniques for application and/or disengagement of said covering elements can be further facilitated and simplified.

SUMMARY OF THE INVENTION

It is an aim of the present invention to obviate the drawbacks found in the known art, by providing a covering element for manual-use articles particularly set for laying of at least one substance, which is of simple and easy application and removal and in addition requires use of one hand alone by the user.

In accordance with the present invention, this aim is achieved by a covering element for articles particularly set for laying of at least one substance, or by a manual-use article provided with said covering element, in accordance with the features described and claimed in the appended claims.

BRIEF DESCRIPTION OF THE DRAWINGS

The present invention will be now described with reference to the accompanying drawings showing a preferred, but not exclusive, embodiment of a covering element for articles particularly set for laying of at least one substance, and/or of a manual-use article provided with said covering element, in accordance with the present invention. In the drawings:

FIG. 3 is a diagrammatic view showing release of the covering element seen in the preceding figures, carried out by a manual thrust action;

FIG. 4 is a diagrammatic view of the coupling operation between the covering element and the respective article, carried out by a manual thrust action contrary to the one causing release;

DESCRIPTION OF THE PREFERRED EMBODIMENT

Figure 5:
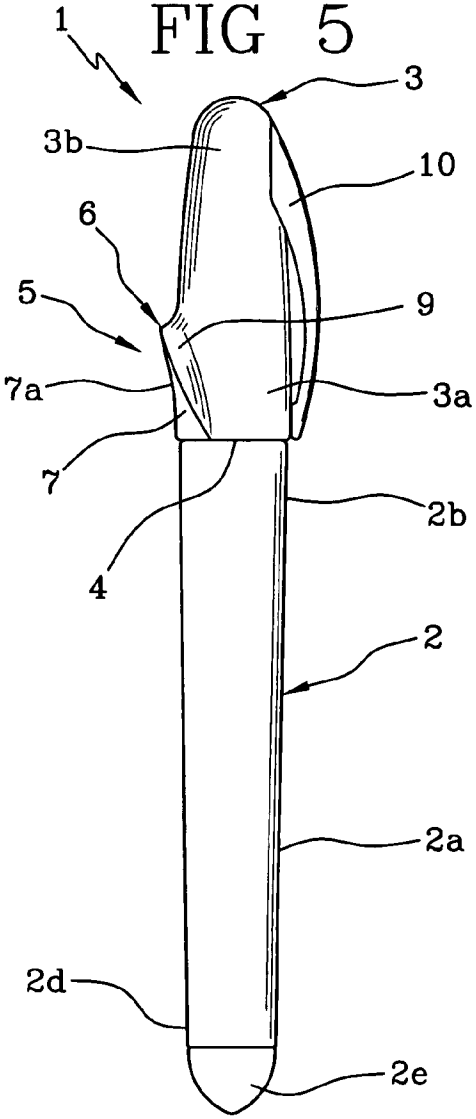
FIG. 5 is an elevation view of a further embodiment of the covering element in accordance with the present invention.

With reference to the drawings, a covering element for manual-use articles particularly set for laying of at least one substance, in accordance with the present invention, has been generally identified by reference numeral 1.

In particular, the covering element 1 is adapted to be employed on any type of article 2 (FIGS. 1 and 3 to 5) for manual use that can be found in different merchandise fields such as the field of stationery articles, beauty preparations, articles for medical treatments, body treatments and so on. In other words, the covering element 1 can find application in any merchandise sector where there is the presence of articles 2 to be at least partly covered and protected.

Referring particularly to FIGS. 1 and 3 to 5, the article 2 herein shown by way of example and therefore not for purposes of limitation of the present invention, preferably is a cylindrical stationery article 2 such as a pen, a felt-tip pen, a correction fluid, a glue and/or the like.

Still referring to FIGS. 1 and 3 to 5, article 2 comprises a body 2*a* of substantially elongated shape having at least one use portion 2*c* (partly seen in FIG. 3) at one end 2*b* thereof, which portion is designed to be at least partly covered with said covering element 1 in a non-use condition. On the opposite side from the first end 2*b*, article 2 has a second end 2*d* of a substantially tapering and rounded conformation, the section of which progressively decreases so that it terminates with a portion 2*e* that is able to receive in engagement by interference fit, the above mentioned covering element 1 during use of the article itself.

Figure 2:
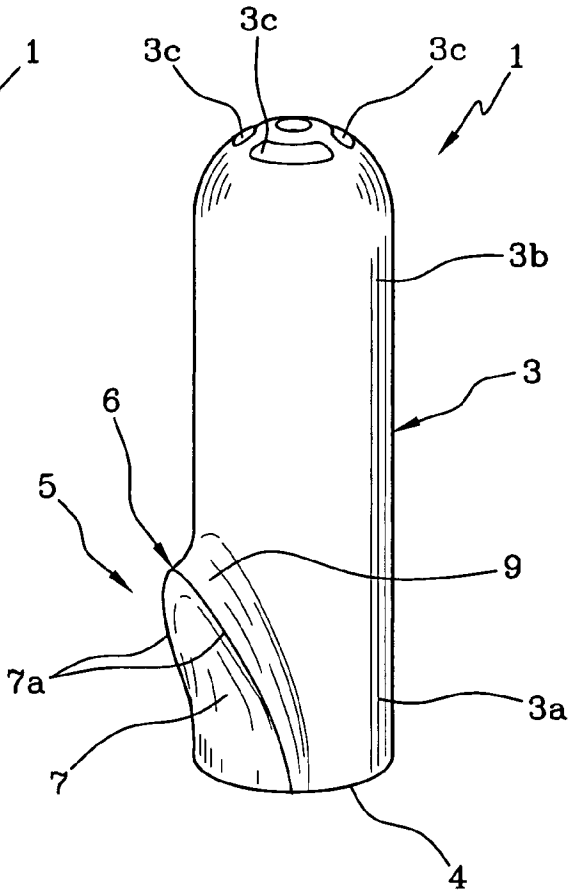
FIG. 2 is a perspective view of the element seen in the preceding figure and herein represented alone.
Figure 1:
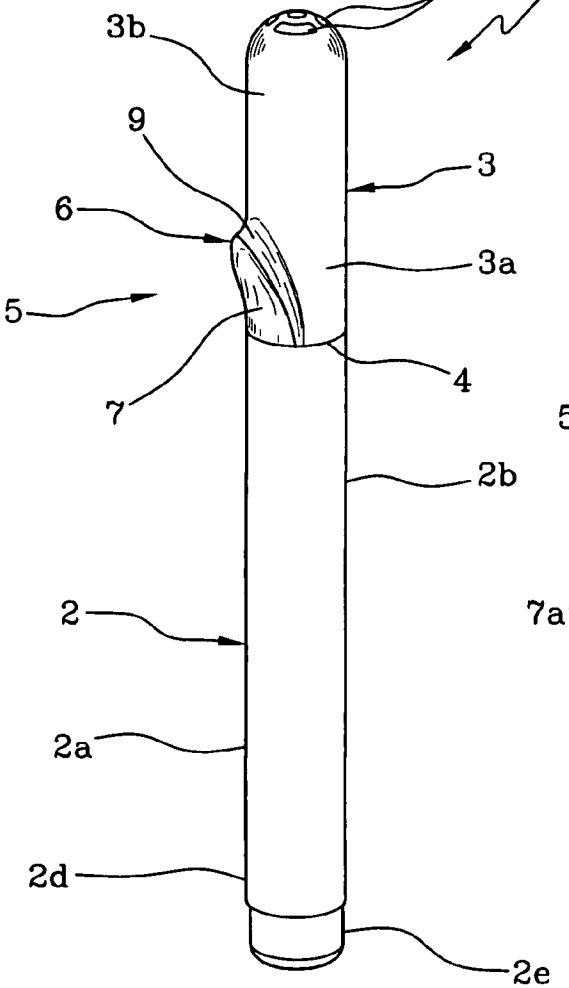
FIG. 1 is a perspective view of a covering element applied to a respective article for manual use, in accordance with the present invention.

Still with reference to the accompanying figures, the covering element 1 comprises at least one hollow case 3 of substantially elongated and tapering shape. In detail, the hollow case 3 has a first end 3*a* provided with a suitable access opening 4 to receive the use portion 2*c* of article 2 when the latter is not used and a second substantially rounded end 3*b*, opposite to the first one 3*a* that, in case of need, is provided with suitable aeration ports 3*c* (FIGS. 1, 2 and 5).

The covering element 1 further comprises coupling means (not shown as it is known) associated with the hollow case 3 to steadily engage the covering element 1 with the respective article 2. Preferably, the coupling means has at least one snap-hooking system co-operating with respective coupling elements (not shown) disposed on the first end 2*b* of article 2, in such a manner as to counteract possible detachment of the covering element 1.

Advantageously, the covering element 1 comprises abutment means 5 associated with the hollow case 3 to cause shifting of the covering element, following at least one manual action by a user, between a coupled condition (FIGS. 1, 4 and 5) at which it engages the respective article 2 and a released condition (FIGS. 2 and 3) at which it is separated therefrom.

As shown in the accompanying drawings, the abutment means 5 contemplates the presence of at least one protrusion 6 jutting out externally of the hollow case 3, transversely of the longitudinal extension of same. In particular, the protrusion 6 has a first abutment surface 7 placed near the body 2*a* of the article 2 when the covering element 1 is disposed in the coupled condition (FIGS. 1, 4 and 5). The first abutment surface 7 appears on the opposite side with respect to case 3, preferably following an inclined extension relative to the longitudinal extension of the covering element 1. More specifically, the first abutment surface 7 radially moves away from the hollow case 3 starting from the first end 3*a* of the latter towards the second end 3*b*.

Referring again to the accompanying drawings, the first abutment surface 7 has an arched extension. Preferably, said first abutment surface 7 is substantially concave and defines a recessed central region and raised peripheral regions, respectively.

As shown in FIG. 2, the first abutment surface 7 has a substantially rounded peripheral edge 7*a* the outline of which has an at least partly elliptical conformation. The shape of the first abutment surface 7 advantageously matches that of the fingertip 8*a* of one finger, preferably the thumb 8*b*, of one hand 8 so that it is adapted to receive the corresponding finger in ergonomic engagement.

The protrusion 6 further has a second abutment surface 9 extending between the first abutment surface 7 and the hollow case 3, transversely of the latter and of the first abutment surface 7. In detail, the second abutment surface 9 extends starting from the peripheral edge 7*a* of the first abutment surface 7 to joint the outer surface of case 3. In other words, the second abutment surface 9 peripherally extends around the first abutment surface 7 and partly surrounds it.

The second abutment surface 9 too has an arched extension, and is preferably concave. Advantageously, the second abutment surface 9 is connected with the hollow case 3 without a break, so that no line between the second abutment surface 9 and the outer surface of the hollow case 3 can be felt by the touch.

In accordance with a further embodiment of the present invention shown in FIG. 5, the covering element 1 comprises at least one hooking tailpiece 10 extending from the hollow case 3 for engagement of the covering element 1 with at least one substantially flat portion of a garment, such as a pocket, a loop, and the like.

As shown in FIG. 5 the hooking tailpiece 10 extends from the hollow case 3 on the opposite side relative to protrusion 6 and juts out from the second end 3*b* of the hollow case 3 towards the first end 3*a* of the latter terminating at a position close to the access opening 4.

Operation

Operation of the present invention described above mainly as regards structure, is as follows.

As shown in FIG. 3, when article 2 provided with the above mentioned covering element 1 is to be used, it can be grasped with one hand 8 so that all the fingers, apart from the thumb 8*b*, surround the body 2*a* of article 2 and are closed around it. Advantageously, in this position the thumb 8*b* naturally rests on the protrusion 6 of case 3 of the covering element 1. Consequently, the thumb 8*b* lays on the first abutment surface 7 the particular shape of which ensures the best relationship of mutual adaptation between the user's finger and the covering element 1.

Following a suitable thrust action aiming at moving the covering element 1 away from article 2 (identified in FIG. 3 by the direction arrows "A"), said covering element 1 translates along the longitudinal axis of article 2 moving apart from the use portion 2*c* of the latter.

Obviously, the shape of the first abutment surface 7 allows a thrust action of a sufficient intensity to be carried out by the thumb 8*b* so as to overcome the resistance exerted by the coupling means of the covering element 1 and cause shifting of the covering element itself 1 from the coupled condition to the released condition.

Separation of the covering element 1 is made easier by the user's fingers surrounding the body 2*a* of said article 2 and retaining it.

On the contrary, with reference to FIG. 4, shifting of the covering element 1 from the released condition to the coupled condition is caused by a further thrust action exerted on the covering element 1 in the opposite direction with respect to the release direction (direction arrows "B" in FIG. 4). Under this situation, the user's hand 8 is maintained to a closed condition around article 2, while the thumb 2*b* rides over the peripheral edge 7*a* and bears on the second abutment surface 9 to push the latter towards the element 2. The covering element 1 moves close to the element 2 until the coupling means causes a steady engagement between the covering element 1 and element 2.

With reference to the embodiment shown in FIG. 5, operation of the covering element is unchanged. However, due to the presence of the hooking tailpiece 10, application of the covering element 1 coupled with article 2, to a user's garment is allowed.

The present invention solves the problems found in the known art and reaches the intended purposes.

First of all, due to the particular conformation of the abutment means of the above described covering element, the operation for releasing it from the respective article is facilitated.

In addition, said abutment means can also be used to simplify the coupling operation between the covering element and the corresponding article.

In more detail, the operation for releasing and/or coupling the covering element can be advantageously carried out through use of one hand alone, by a simple and quick movement. In other words, the closing element as designed allows separation from the use portion of the respective article without the aid of the other hand, so that any user physically unable to employ both hands is facilitated.

What is claimed is:

1. An article for manual-use set for laying of at least one substance, comprising:

a body having a tip that is configured to be externally covered; and at least one covering element, said at least one covering element comprising:

at least one hollow case having a first end provided with at least one access opening to receive and protect the tip;

coupling means associated with said case to ensure engagement of said covering element with the body, said article further comprises abutment means associated with said case to cause shifting of said covering element, by effect of at least one manual action, between a coupled condition at which said at least one covering element engages a respective said body and a released condition at which said at least one covering element is separated from said body, wherein said abutment means comprises at least one protrusion jutting out externally of said case, transversely of a longitudinal extension of the covering element, wherein said at least one protrusion has a first abutment surface placed near said body when said covering element is disposed in the coupled condition, and wherein said first abutment surface is inclined to said case and moves radially away from said case, starting from said first end of the at least one hollow case towards a second end of the at least one hollow case.

2. The article as claimed in claim 1, wherein said first abutment surface has a substantially arched extension.

3. The article as claimed in claim 1, wherein said first abutment surface is concave.

4. The article as claimed in claim 1, wherein said first abutment surface has an at least partly rounded peripheral edge.

5. The article as claimed in claim 4, wherein said peripheral edge of said first abutment surface has an at least partly elliptical outline.

6. The article as claimed in claim 1, wherein said protrusion has a second abutment surface extending between said first abutment surface and said case, transversely with respect to said case and to said first abutment surface.

7. The article as claimed in claim 6, wherein said second abutment surface peripherally extends around said first abutment surface.

8. The article as claimed in claim 6, wherein said second abutment surface has an arched extension.

9. The article as claimed in claim 6, wherein said second abutment surface is concave.

10. The article as claimed in claim 6, wherein said second abutment surface is joined to said case.

11. The article as claimed in claim 1, further comprising at least one hooking tailpiece extending from said case for engagement of said covering element with at least one substantially flat portion of a garment.

12. The article as claimed in claim 11, wherein said hooking tailpiece extends from said case on the opposite side relative to said at least one protrusion.

* * * * *